US006670735B2

(12) United States Patent
Liu

(10) Patent No.: US 6,670,735 B2
(45) Date of Patent: Dec. 30, 2003

(54) WEIGHT RELEASE MECHANISM FOR UNDERWATER OBJECT

(75) Inventor: Ruey-Shan Liu, Kaohsiung (TW)

(73) Assignee: Chung-Shan Institute of Science and Technology, Taoyuan (TW)

( * ) Notice: Subject to any disclaimer, the term of this patent is extended or adjusted under 35 U.S.C. 154(b) by 36 days.

(21) Appl. No.: 10/015,447

(22) Filed: Dec. 12, 2001

(65) Prior Publication Data

US 2003/0107277 A1 Jun. 12, 2003

(51) Int. Cl.[7] ..... H02K 5/10; B63C 11/00

(52) U.S. Cl. ..... 310/87; 405/186; 440/6; 114/315

(58) Field of Search ..... 310/89, 90, 91, 310/81; 294/66.1, 67.1, 67.3, 67.31, 88, 86.1, 86.4, 81.4, 81.51; 405/186; 440/6; 114/315

(56) References Cited

U.S. PATENT DOCUMENTS 3,056,623 A * 10/1962 Herbert ..... 294/82.26
4,372,597 A * 2/1983 Stillman et al. ..... 294/81.4
4,445,719 A * 5/1984 Miller et al. ..... 294/88
5,685,590 A * 11/1997 Sharrow ..... 294/68.3

* cited by examiner

*Primary Examiner*—Tran Nguyen
(74) *Attorney, Agent, or Firm*—J. C. Patents

(57) ABSTRACT

A weight release mechanism for an underwater object. Through a detachable latching mechanism between the underwater object and a heavy block and a set of control circuits, the underwater object may be released from the heavy block without any damages to the latching mechanism and may be reused many times. The releasing process is triggered by an electrically driven rotation.

6 Claims, 4 Drawing Sheets

WEIGHT RELEASE MECHANISM FOR UNDERWATER OBJECT

BACKGROUND OF THE INVENTION

1. Field of Invention

The present invention relates to a weight release mechanism for an underwater object. More particularly, the present invention relates to the weight release mechanism of a recyclable underwater object.

2. Description of Related Art

Underwater objects are often deployed at the bottom of ocean to investigate seismic activities or deployed underwater in other oceanography research projects. To retrieve the underwater object for reuse, most underwater objects are designed to include some self-buoyancy. The self-buoyant underwater object is connected to a dead weight so that the buoyancy is canceled. The dead weight pulls the underwater object to sea bottom so that all kinds of oceanographic researches and tests can be conducted. To retrieve the underwater object, the connection mechanism linking the underwater object and the weight is severed so that the dead weight is discarded while the underwater object rises to the surface under its buoyancy force. The underwater object is then collected for further analysis or reused.

After the completion of an underwater mission, the underwater object is released back to the surface by remotely triggering a small explosion to break up the linkage that originally joins the underwater object and the dead weight together. Once the linkage connecting the dead weight and the underwater object is cut, the weight is dumped. Through self-buoyancy, the underwater object rises to the surface for collection. However, the use of explosives by remote control to break the connection is not very reliable. The explosive may damage the underwater object because the precise amount of explosives needed to break up the linkage is difficult to predict.

SUMMARY OF THE INVENTION

Accordingly, one object of the present invention is to provide a simple-to-operate, low-cost and safe weight releasing mechanism for an underwater object. Through a detachable latching mechanism between the underwater object and a matching weight together with various remote-control driving circuits, the matching weight of the underwater object is easily released. The detachable latching mechanism is a damage-free mechanism that may operate repeatedly to release any attached weights. Since separation of the weight from the underwater object is effected by electrically driven rotation, power needed to release the heavy block can be easily estimated.

To achieve these and other advantages and in accordance with the purpose of the invention, as embodied and broadly described herein, the invention provides a weight releasing mechanism for an underwater object. The releasing mechanism facilitates the separation of the underwater object from a heavy block and hence the subsequent retrieval of the underwater object on the surface of water. The underwater object is intrinsically buoyant and has a groove for engaging a heavy block. The groove has a bottom surface with a through hole. The underwater object's weight releasing mechanism includes a heavy block, one or more springs, a bearing and an electric motor.

The heavy block is engaged inside the groove so that the weight of the heavy block may overcome the buoyancy force of the underwater object and make the underwater object sink to the bottom. The heavy block has a flat surface. The flat surface has a latching groove and a spring groove thereon. The latching groove has an opening. When the heavy block is put inside the heavy block groove, the flat surface of the heavy block is pressed against the bottom surface of the heavy block groove.

A spring is put inside each spring groove. Overall length of the spring is larger than the depth of the spring groove. When the heavy block is put inside the heavy block groove, the ends of the spring are in contact with the bottom section of the spring groove and the bottom surface of the heavy block groove respectively. In other words, the spring is compressed to store up a spring load.

The bearing is installed inside the underwater object. A rotary spindle is tightly engaged inside the through-hole and fixed relative to the bearing so that the spindle may rotate inside the through hole. The spindle further includes a first end and a second end. The first end is inside the heavy block groove while the second end is inside the underwater object. Furthermore, the first end has an engaging block. The cross-sectional profile of the engaging block at the first end is identical to the opening profile of the latching groove. Hence, the first end of the spindle may insert into the latching groove via the opening so that the engaging block can rotate inside the latching groove. The engaging block may hook to the latching groove interior so that the heavy block is fixed inside the heavy block groove.

The electric motor is enclosed inside the underwater object and coupled with the second end of the spindle so that the motor can drive the rotary spindle. The motor may further incorporate a set of rotary speed reduction gears. To ensure a perfect seal between spindle and through hole, a sealing ring may also be added to the spindle.

One major aspect of this invention is the introduction of a detachable latching mechanism to engage a detachable heavy block with the underwater object. Hence, the heavy block may be released without employing any explosives. Ultimately, the assembly is much safer to use.

Instead of destroying the linkage between the heavy block and the underwater object, the detachable latching mechanism of this invention may be used repeatedly without any damage.

Another characteristic of this invention is that the release mechanism is driven by electrically driven rotation so that the power for releasing of the heavy block from the underwater object can be estimated precisely.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DESCRIPTION OF THE PREFERRED EMBODIMENTS

Figure 1:
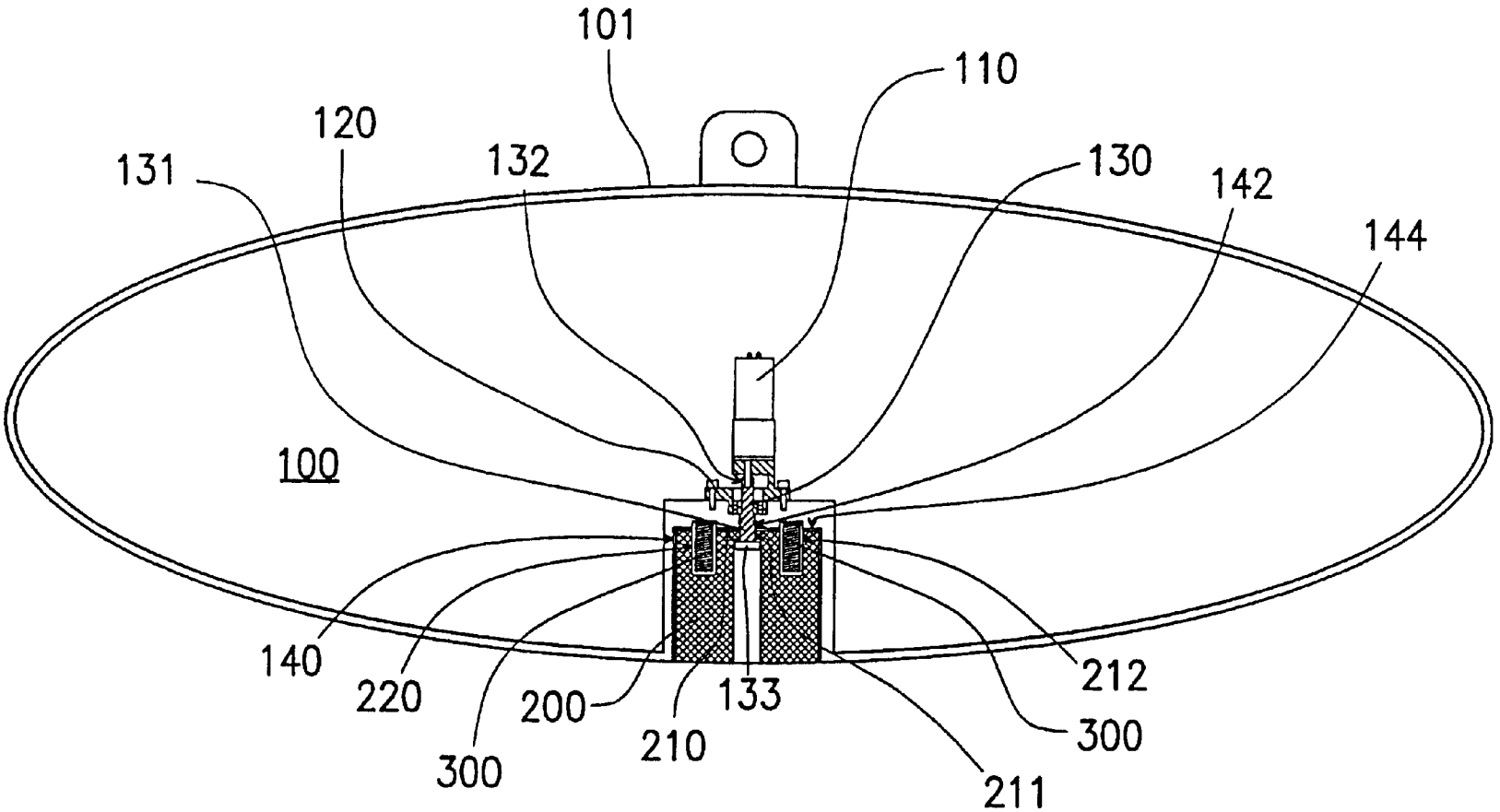
FIG. 1 is a schematic diagram showing a cross-sectional view of a detachable latching mechanism for engaging a heavy block onto an underwater object according to one preferred embodiment of this invention.

Reference will now be made in detail to the present preferred embodiments of the invention, examples of which are illustrated in the accompanying drawings. Wherever possible, the same reference numbers are used in the drawings and the description to refer to the same or like parts.

FIG. 1 is a schematic diagram showing a cross-sectional view of a detachable latching mechanism for engaging a heavy block onto an underwater object according to one preferred embodiment of this invention. The weight releasing mechanism for an underwater object (refer to FIG. 1) is mainly applied to the release of a heavy block 200 engaged to an underwater object 100. The underwater object 100 can be retrieved on the surface after releasing the heavy block 200 because the underwater object 100 is able to rise to the surface through intrinsic buoyancy.

As shown in FIG. 1, the main body 101 of the underwater object 100 has a heavy block groove 140 for engaging with a heavy block 200. A bottom surface 144 of the groove 140 has a through hole 142. A rotary spindle 130 passes through the through hole 142. The rotary spindle 130 and the through-hole 142 fit together with a tight tolerance. A first end of the spindle 130 is outside the main body but inside the groove 140 while the second end of the spindle 130 is inside the main body 101. The other side of the bottom surface 142 inside the main body 101 has a bearing 120. The spindle 130 is fixed by the bearing 120 so that the spindle 130 may rotate inside the through-hole 142. The interior of the main body 102 further includes an electric motor 110. The electric motor 110 couples with the second end 132 of the spindle 130 so that the spindle 130 rotates when the electric motor 110 is powered. The first end 131 of the spindle 130 further includes an engaging block 133.

A flat surface 210 of the heavy block 200 has a latching groove 211 and a plurality of spring grooves 212. Each spring groove 212 has a spring 300 therein. The uncompressed length of each spring 300 is longer than the depth of the spring groove 212. As the heavy block 200 is placed inside the groove 140, the flat surface 210 of the heavy block 200 is pushed against the bottom surface 144 of the groove 140. Meanwhile, both ends of a spring prop against the bottom surface the spring groove 212 and the bottom surface 144 of the heavy block groove 140 so that the spring is compressed to store up elastic energy.

Figure 2B:
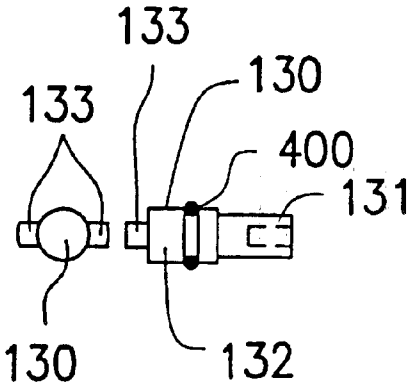
FIGS. 2*a* and 2*b* are top and side view showing the engaging position between the engaging block of the rotary spindle and the latching groove on the heavy block according to this invention.
Figure 2A:
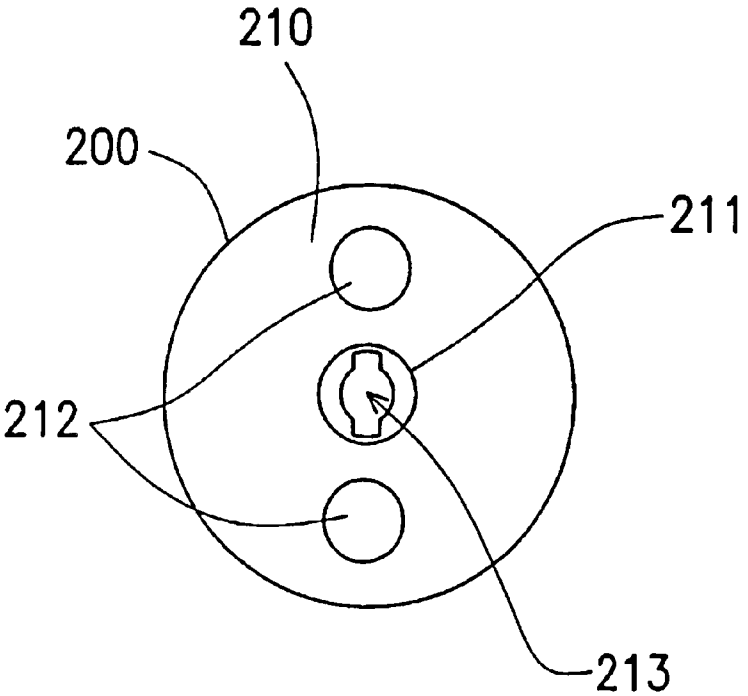
Figure 4B:
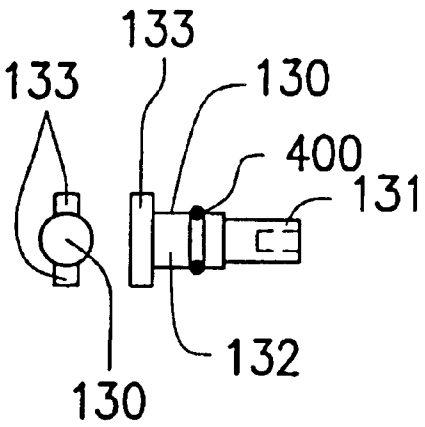
FIGS. 4*a* and 4*b* are top and side view showing the releasing position between the engaging block of the rotary spindle and the latching groove on the heavy block according to this invention.
Figure 4A:
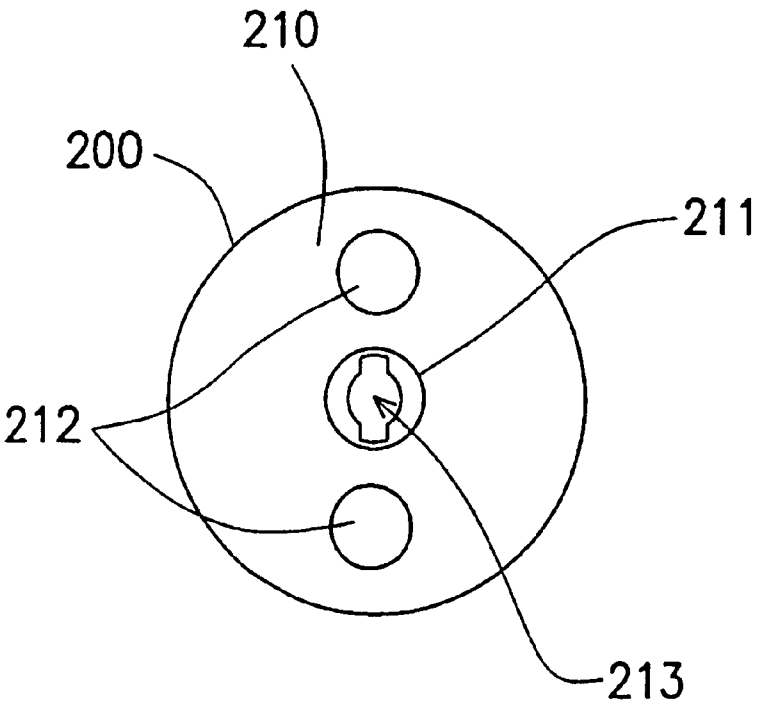

In this invention, an identical cross-sectional profile is used for both the engaging block 133 at the first end 131 of the spindle 130 and an opening 213 within the latching groove 211. FIGS. 4*a* and 4*b* are top and side view showing the releasing position between the engaging block of the rotary spindle and the latching groove on the heavy block according to this invention. When the engaging block 133 is rotated to a position corresponding to the opening 213 as shown in FIGS. 4*a* and 4*b*, the first end 131 of the spindle 130 may pass through the opening 213 into the latching groove 211 and rotate inside. FIGS. 2*a* and 2*b* are top and side view showing the engaging position between the engaging block of the rotary spindle and the latching groove on the heavy block according to this invention. On the other hand, when the first end 131 of the spindle 130 inside the latching groove 211 is rotated to a position away from the opening position 213, the engaging block 133 is unable to disengage through the opening 213 of the latching groove 211. Hence, the engaging block 133 is hooked inside the opening 213 and the heavy block 200 is stationed inside the groove 140. In other words, the heavy block 200 and the underwater object 100 are joined together facilitating underwater operation.

Figure 3:
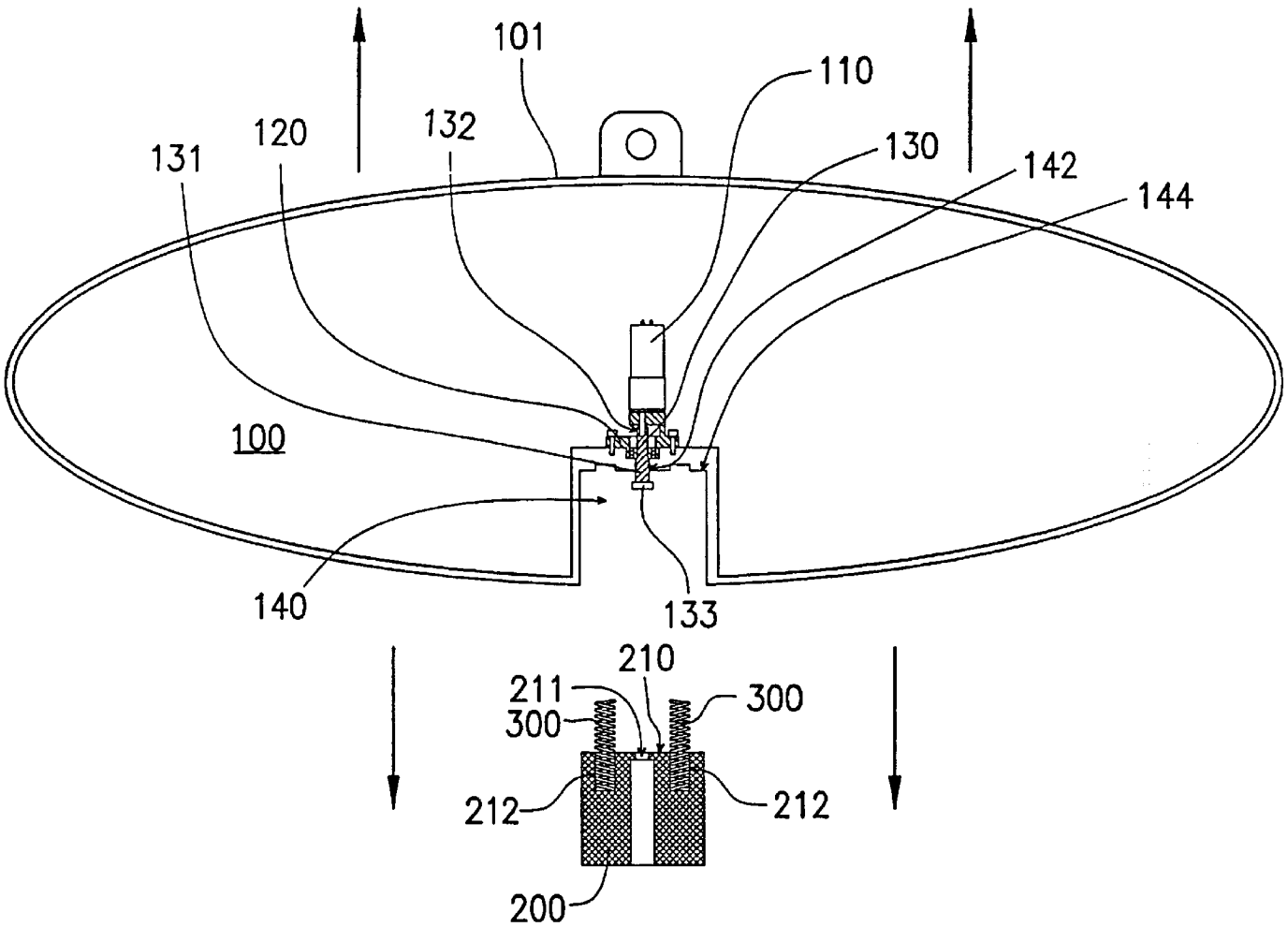
FIG. 3 is a schematic diagram showing the heavy block detaching from the underwater object after triggering the release mechanism according to this invention.

To retrieve the underwater object 100, various time or remote control circuit (not shown) may be used to trigger the electric motor 110. The electric motor 110 drives the spindle 130 so that the engaging block 133 rotates to a position corresponding to the opening 213 (as shown in FIG. 4*a*). Thereafter, the engaging block 133 may slip out through the opening 213. The loaded springs 300 inside various spring grooves 212 also assist the ejection of the underwater object 100 away from the heavy block 200 as shown in FIG. 3. The released underwater object 200 floats to the surface due to intrinsic buoyancy and is subsequently collected.

To ensure a tight seal between the rotary spindle 130 and the through-hole 142, a seal ring 400 is often added to the spindle 130 as shown in FIGS. 2*b* and 4*b*. Furthermore, a set of gears may also be used to reduce the rotation speed or increase the torque of the electric motor 110.

In conclusion, major advantages of this invention includes:

1. A detachable latching mechanism is introduced between the underwater object and a heavy block. Latching is driven by an electric motor controlled through an electric circuit. Since explosives are no longer used, the assembly is safe to handle.
2. Since no explosives are used in the detaching mechanism, damages to components are minimized and hence the underwater object is quite durable.
3. Since the heavy block attached to the underwater object is released by electrically driven rotation, power needed to carry out the release can be accurately estimated. Moreover, various electrical circuits may be used to time and control the moment of release.
4. The detachable latching mechanism is simple to operate and easy to install inside various types of underwater objects. In addition, the heavy block to be discarded is made from low cost material.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A weight release mechanism for an underwater object that facilitates the retrieval of the underwater object, wherein the underwater object is self-buoyant and contains a heavy block groove, the groove has a bottom surface with a through-hole thereon, the mechanism comprising of:

a heavy block that fits inside the heavy block groove, wherein the heavy block has a weight capable of overcoming the buoyancy force of the underwater object so that the heavy block and the underwater object will sink to the bottom when dropped into a pool of water, the heavy block has a flat surface and the flat surface includes a latching groove and one or more spring grooves, the latching groove further includes an opening, and the flat surface presses against the bottom surface of the heavy block when the heavy block is engaged inside the heavy block groove;

a spring inside the spring groove, wherein the spring has a free length greater than the depth of the spring groove so that the spring are compressed between the bottom of the spring groove and the bottom surface of the heavy block groove when the heavy block is engaged inside the heavy block groove;

a bearing within the underwater object;

a rotary spindle tightly inserted into the through-hole and fixed relative to the bearing so that the rotary spindle rotates inside the through-hole, wherein the spindle has a first end and a second end, the first end is within the heavy block groove and second end is in the interior of the underwater object, the first end further includes an engaging block, sectional profile of the engaging block at the first terminal is identical to the opening in the latching groove so that the first end of the rotary axle inserts into the latching groove via the opening and the engaging block rotates inside the latching groove so that the engaging block hooks inside the lathing groove with the heavy block fixed inside the heavy block groove; and an electric motor inside the underwater object engaged with the second end of the rotary spindle for driving the spindle.

2. The weight release mechanism of claim 1, wherein the electric motor further incorporates a set of gears to reduce rotational speed.

3. The weight release mechanism of claim 1, wherein the rotary spindle further includes a sealing ring for tightening the seal between the rotary spindle and the through hole.

4. An underwater object, comprising:

a main body having self-buoyancy, wherein the main body includes a heavy block groove, the heavy block groove has an interior bottom surface and the bottom surface has a through-hole thereon;

a heavy block fitted inside the heavy block groove, wherein weight of the heavy block overcome the self-buoyancy of the underwater object so that the assembled heavy block together with the underwater object sinks to the bottom when released from water surface, the heavy block further includes a flat surface having a latching groove and one or more spring grooves, the latching groove further includes an opening such that the flat surface of the heavy block presses against the bottom surface of the heavy block groove when the heavy block is engaged into the heavy block groove;

a spring inside each spring groove, wherein uncompressed length of the spring is greater than depth of the spring groove so that the spring is compressed between the bottom section of the spring groove and the bottom surface of the heavy block groove to store up elastic energy when the heavy block is engaged to the heavy block groove;

a bearing inside the main body;

a rotary spindle tightly engaged within the through-hole and fastened to the bearing so that the spindle is free to rotate inside the through-hole relative to the bearing, wherein the spindle has a first end and a second end, the first end is located inside the heavy block groove and the second end is located in the interior of the main body, the first end further includes an engaging block whose cross-sectional profile is identical to the opening profile of the latching groove so that the first end of the spindle inserts into the latching groove via the opening and the engaging block rotates inside the latching groove, and the engaging block also hooks inside the latching groove so that the heavy block is tightly fastened to the heavy block groove; and an electric motor inside the main body coupled to the second end of the spindle for rotating the spindle.

5. The underwater object of claim 4, wherein the electric motor also incorporates a set of gears to reduce rotational speed.

6. The underwater object of claim 4, wherein the rotary spindle further includes a sealing ring for tightening the seal between the rotary spindle and the through hole.

* * * * *